US008163060B2

(12) United States Patent
Imanishi et al.

(10) Patent No.: US 8,163,060 B2
(45) Date of Patent: Apr. 24, 2012

(54) HIGHLY HEAT-CONDUCTIVE COMPOSITE MATERIAL

(75) Inventors: Terumitsu Imanishi, Hyogo (JP); Kazuaki Katagiri, Hyogo (JP); Akiyuki Shimizu, Hyogo (JP); Toyohiro Sato, Hyogo (JP); Nobuhito Nakama, Hyogo (JP); Atsushi Kakitsuji, Osaka (JP); Katsuhiko Sasaki, Hokkaido (JP)

(73) Assignees: Sumitomo Precision Products Co., Ltd., Amagasaki shi (JP); Osaka Prefectural Government, Osaka-shi (JP)

( * ) Notice: Subject to any disclaimer, the term of this patent is extended or adjusted under 35 U.S.C. 154(b) by 98 days.

(21) Appl. No.: 12/667,137

(22) PCT Filed: Jul. 2, 2008

(86) PCT No.: PCT/JP2008/061956

§ 371 (c)(1),
(2), (4) Date: Jul. 21, 2010

(87) PCT Pub. No.: WO2009/005082

PCT Pub. Date: Jan. 8, 2009

(65) Prior Publication Data

US 2011/0000336 A1 Jan. 6, 2011

(30) Foreign Application Priority Data

Jul. 5, 2007 (JP) ..... 2007-177453

(51) Int. Cl.
*B22F 3/00* (2006.01)

(52) U.S. Cl. ..... 75/229; 75/243; 75/249

(58) Field of Classification Search ..... 75/229, 75/243, 249; 419/11, 24
See application file for complete search history.

(56) References Cited

U.S. PATENT DOCUMENTS

| | | | | | |
|---|---|---|---|---|---|
| 4,500,360 | A | * | 2/1985 | Wakayama et al. | 106/286.5 |
| 4,722,751 | A | * | 2/1988 | Akechi et al. | 75/232 |
| 4,961,779 | A | * | 10/1990 | Kusui et al. | 75/231 |
| 5,981,085 | A | * | 11/1999 | Ninomiya et al. | 428/614 |
| 2007/0057415 | A1 | | 3/2007 | Katagiri et al. | |
| 2007/0134496 | A1 | | 6/2007 | Katagiri et al. | |

FOREIGN PATENT DOCUMENTS

| | | |
|---|---|---|
| JP | 3 177505 | 8/1991 |
| JP | 9 157773 | 6/1997 |
| WO | 2006 120803 | 11/2006 |

OTHER PUBLICATIONS

U.S. Appl. No. 12/595,137, filed Oct. 9, 2009, Katagiri, et al.

* cited by examiner

*Primary Examiner* — Roy King
*Assistant Examiner* — Ngoclan T Mai
(74) *Attorney, Agent, or Firm* — Oblon, Spivak, McClelland, Maier & Neustadt, L.L.P.

(57) ABSTRACT

The heat conductivity of an aluminum composite material containing a fibrous carbon material is enhanced. In order to realize this, a spark plasma sintered body having a fibrous carbon material compounded in a metal matrix powder of aluminum or the like is fabricated. At the time of fabrication, an aluminum powder serving as a matrix mother material is compounded with an Al alloy powder such as an Al-12Si powder having a melting point lower than the sintering temperature of the mother material. During the process of sintering the aluminum powder, the Al alloy powder is melted, whereby the heat conductivity between the aluminum powder particles and between the aluminum powder particle and the fibrous carbon material is improved.

2 Claims, 5 Drawing Sheets

(a)

(b)

HIGHLY HEAT-CONDUCTIVE COMPOSITE MATERIAL

TECHNICAL FIELD

The present invention relates to a highly functional highly heat-conductive composite material endowed with excellent heat conductivity, electric conductivity, mechanical properties, and others in addition to various features inherently owned by a matrix, by mixing a fibrous carbon material such as a vapor growth carbon fiber (VGCF) into a matrix made from a metal material.

BACKGROUND ART

As the fibrous carbon material, a carbon nanotube (CNT) and a vapor growth carbon fiber (VGCF) are well known. Both the carbon nanotube and the vapor growth carbon fiber are fine tube form structures constituted with graphene, and are differentiated by the difference in the lamination structure and the fiber diameter associated therewith, as will be described below.

Graphene is a net of honeycomb structure in which six carbon atoms are regularly arranged in a two-dimensional manner, and is also referred to as a carbon hexagonal net plane. The substance in which this graphene is laminated with regularity is referred to as graphite. A single-layer or multiple-layer fine tube form structure constituted with this graphene is a fibrous carbon material, and includes both a carbon nanotube and a vapor growth carbon fiber.

That is, the carbon nanotube is a seamless tube in which graphene is rounded in a tubular shape, and may be a single-layer one or a multiple-layer one in which the layers are concentrically laminated. The single-layer one is referred to also as a single-layer nanotube, and the multiple-layer one is referred to also as a multiple-layer nanotube.

Also, the vapor growth carbon fiber is one having, in a core part, a graphene tube of a single layer or plural layers in which graphene is rounded in a tubular shape, namely a carbon nanotube, where graphite is laminated in a radial direction of the graphene tube so as to surround the core part in a multiple manner and in a polygonal shape, and is referred to also as a super multiple-layer carbon nanotube because of its structure.

In other words, the single-layer or multiple-layer carbon tube that is present at the central part of a vapor growth carbon fiber is a carbon nanotube.

Various composite materials are proposed that aim at improvements in the heat conductivity, electric conductivity, and mechanical properties by the fibrous carbon material while taking advantage of the characteristic features of a metal or ceramics by allowing such a fibrous carbon material to be contained in a metal, ceramics, or further a mixture of these. One of these is a CNT-containing aluminum composite material disclosed in Patent Document 1.

Patent Document 1: International Publication WO2005/040067 pamphlet

This composite material was previously developed by the present inventors, and is one obtained by using a spark plasma sintered body of an aluminum powder as a matrix and mixing a carbon nanotube into this matrix. Aluminum has a high heat conductivity, and is suitable as a matrix of a highly heat-conductive composite material. However, when aluminum is melted in a process of producing a composite material, the aluminum reacts with the carbon nanotube to generate Al—C, thereby considerably deteriorating the material strength. For this reason, it is assumed to be suitable to form aluminum into a matrix by the powder sintering method.

In the powder sintering method, the powder particles are joined with each other by solid phase diffusion at or below the melting point, so that there is no fear that Al—C is generated. However, the produced powder sintered body contains a certain amount of pores, thereby causing a decrease in the heat conductivity. It is the spark plasma sintering method that solves this problem.

The spark plasma sintering method is also referred to as the pulse energization method or the pulse energization pressurizing sintering method, in which, by using a high temperature plasma generated between the powder particles, the adhesion property between adjacent powder particles is enhanced to approximate the porosity within the sintered body infinitely to zero, and also the oxide on the particle surface is made to disappear, thereby contributing to an improvement in the heat conductivity of the matrix itself and an improvement in the heat conductivity between the matrix and the fibrous carbon material.

As to the fibrous carbon material that is allowed to be contained in the matrix as a heat propagation promoting material, it has been found out from recent researches that the heat conductivity will be more improved when a vapor growth carbon fiber having a larger diameter than a carbon nanotube is combined. The vapor growth carbon fiber is easily oriented in a specific direction because of being thicker and longer than the carbon nanotube, so that the effect of improving the heat conductivity in the orientation direction is particularly large.

However, even with a composite material using a spark plasma sintered body of an aluminum powder as a matrix and allowing a vapor growth carbon fiber to be oriented and contained in the matrix, the content of the vapor growth carbon fiber must be made considerably large in order to ensure a high heat conductivity. For example, the heat conductivity of a spark plasma sintered body of an aluminum powder alone serving as a matrix is about 200 W/mK. In order to increase this to about 400 W/mK, which is the double amount, as much as 50 vol % of the vapor growth carbon fiber will be needed.

Since the fibrous carbon material is expensive, the increase in the amount of use thereof directly affects the cost rise of the composite material, so that development of a technique capable of efficiently improving the heat conductivity with a small amount of the fibrous carbon material is waited for.

DISCLOSURE OF THE INVENTION

Problems to be Solved by the Invention

An object of the present invention is to provide a highly heat-conductive composite material capable of effectively enhancing the heat conductivity improvement effect by allowing a fibrous carbon material to be contained.

Means for Solving the Problems

In order to achieve the aforementioned object, the present inventors have paid attention to a matrix in an aluminum composite material containing a fibrous carbon material. As described above, a spark plasma sintered body of an aluminum powder is effective as the matrix. However, even with the spark plasma sintered body, no complete joining is present between the adjacent powder particles and between the powder particle and the fibrous carbon material. In other words, the porosity of the spark plasma sintered body is not zero.

Under these circumstances, the present inventors have considered that there is room for improvement of the heat conductivity in reducing the little space that is present between the powder particles and between the powder particle and the fibrous carbon material in a spark plasma sintered body, and have planned to fill this space with a third material. The present inventors carried out spark plasma sintering by mixing an Al—Si alloy with an aluminum powder serving as a matrix-forming material, and investigated the various characteristics of the fabricated aluminum composite material containing the fibrous carbon material. As a result thereof, the following fact has been found out.

In the case of a matrix alone that does not contain a fibrous carbon material, by compounding an Al—Si alloy powder with an aluminum powder, the heat conductivity of the spark plasma sintered body will decrease a little. However, when a fibrous carbon material is compounded within the matrix, the heat conductivity will be improved by compounding an Al—Si alloy powder with an aluminum powder. This seems to be due to the following reason. The melting point of an Al—Si alloy is lower than the sintering temperature of aluminum serving as a mother material of the matrix, so that the Al—Si alloy powder is melted during the process of sintering the mother material metal powder and fills the gap between the adjacent mother material powder particles and between the mother material powder particle and the fibrous carbon material, whereby the porosity of the composite material will decrease.

Further, an Al—Si alloy has a better wettability to the fibrous carbon material as compared with aluminum, and this also seems to contribute to an improvement in the heat conductivity.

The highly heat-conductive composite material of the present invention has been completed based on the above findings and characterized in that the material is made from a mixture of a metal matrix and a fibrous carbon material and the metal matrix is a metal powder sintered body made from a mixed powder of a sintering source material powder made of pure Al or an Al alloy and a metal powder auxiliary agent made of an Al—Si alloy as a source material, and the compounding ratio of the Al—Si alloy in the metal matrix is 5 to 20% by weight ratio, the Si amount in the Al—Si alloy is within a range of 9 to 15 wt %, and the melting point of the Al—Si alloy is adjusted to be lower than the sintering temperature of the sintering source material powder.

In the highly heat-conductive composite material of the present invention, the sintering source material powder for forming the metal matrix contains a metal powder auxiliary agent made of an alloy belonging to the same series as the source material powder metal and having a melting point lower than the sintering temperature of the source material powder. Therefore, during the process of sintering the source material powder, the metal powder auxiliary agent compounded into this and having a low melting point is melted and fills the gap between the adjacent source material powder particles and between the source material powder particle and the fibrous carbon material, whereby the porosity decreases to improve the heat conductivity.

Regarding themetal powder auxiliary agent that is important in the highly heat-conductive composite material of the present invention, the melting point thereof is important, and is preferably lower by 30° C. or more as compared with the sintering temperature of the sintering source material powder that is combined with this, and more preferably lower by 50° C. or more. When this difference is too small, the melting, extension, and wettability of the metal powder auxiliary agent will be insufficient, giving rise to a fear that the fine pores may remain. As to the alloy that will be the metal powder auxiliary agent, the melting point changes in a complex manner in accordance with the amount of alloy elements, so that the amount of alloy elements is selected so as to obtain a desired melting point. There is no restriction on the upper limit of the temperature difference; however, when the temperature difference is too large, uneven distribution or the like due to the fluidization of the melted auxiliary agent may pause a problem. Also, there are cases in which the amount of alloy elements will be large for lowering the melting point of the auxiliary agent alloy, thereby generating a fear that the alloy elements may give adverse effects on the heat conductivity or the like of the composite material. Due to these reasons, the temperature difference between the sintering temperature and the melting point is preferably 150° C. or less.

Examples of the sintering source material powder for forming the matrix include aluminum and an aluminum alloy, titanium and a titanium alloy, copper and a copper alloy, nickel and a nickel alloy, and others; however, from the viewpoint of heat conductivity, mechanical strength, firing property, and the like, it is preferably a pure Al powder or an Al alloy powder such as 3003. The metal powder auxiliary agent combined with aluminum is an Al alloy (Al—Si alloy, Al—Mg alloy, or the like) having a melting point lower than the sintering temperature of the source material powder, and is preferably an Al—Si alloy, more preferably an Al-10Si alloy or an Al-12Si alloy, from the viewpoint of wettability or the like to the fibrous carbon material. Here, belonging to the same series as the source material powder metal means that the mother element of the auxiliary agent alloy is identical to the source material powder metal in the case in which the source material powder metal is a pure metal, and means that the mother element of the auxiliary agent alloy is identical to the mother element of the source material powder metal in the case in which the source material powder metal is an alloy.

In the case in which Al—Si is used as an auxiliary agent alloy, the amount of addition of the Si element in the auxiliary agent alloy is preferably 1 to 18 wt %, more preferably 9 to 15 wt %, in view of the relationship to the temperature difference between the above-described sintering temperature and the melting point. When the amount of addition of the Si element is too small, mainly the wettability is not improved, so that the fine pores will remain, whereas when it is too large, the melting point will be too high.

The compounding ratio of the metal powder auxiliary agent in the metal matrix when Al—Si is used as an auxiliary agent alloy is preferably 5 to 20%, more preferably 10 to 20%, by weight ratio. When the compounding ratio of the metal powder auxiliary agent is too small, the effect of enhancing the heat conductivity is insufficient, whereas when the compounding ratio is too large, secondary disadvantages such as generation of Al—C by melting are produced, thereby adversely affecting the mechanical properties and the heat conductivity of the matrix.

In the case in which Al—Mg is used as the auxiliary agent alloy, the amount of addition of the Mg element in the auxiliary agent alloy is preferably 1 to 50 wt %, more preferably 8 to 50 wt %, in view of the relationship to the temperature difference between the above-described sintering temperature and the melting point. When the amount of addition of the Mg element is either too small or too large, the melting point will be too high.

The compounding ratio of the metal powder auxiliary agent in the metal matrix when Al—Mg is used as an auxiliary agent alloy is preferably 0.5 to 20%, more preferably 1 to 20%, by weight ratio. When the compounding ratio of the metal powder auxiliary agent is too small, the effect of enhancing the heat conductivity is insufficient, whereas when the compounding ratio is too large, secondary disadvantages such as generation of Al—C by melting are produced, thereby adversely affecting the mechanical properties and the heat conductivity of the matrix. The reason why the amount of the auxiliary agent is relatively smaller as compared with the case of Al—Si is that the amount of the alloy elements in the auxiliary agent alloy is relatively large.

A corresponding content of the fibrous carbon material in the highly heat-conductive composite material must be ensured in order to ensure the heat conductivity. However, when the content is too large, the characteristics such as excellent processability and ductility inherently owned by the matrix cannot be sufficiently obtained. In any case, the merits as the composite material cannot be sufficiently obtained. From this viewpoint, the content of the fibrous carbon material is preferably 1 to 65%, more preferably 5 to 60%, by volume ratio.

The kind of the fibrous carbon material is not particularly limited; however, an extremely elongate tubular structure constituted with single-layer or multiple-layer graphene is preferable in view of the heat conductivity. As described above, this extremely elongate tubular structure includes both a carbon nanotube and a vapor growth carbon fiber, and these can be used either alone or by being mixed. However, a thick and long vapor growth carbon fiber having a high straightness is preferable, and it is particularly preferable that this is used by being oriented in a specific direction.

The method of producing the fibrous carbon material is not particularly limited. Any of the arc discharge method, the laser evaporation method, the thermal decomposition method, the chemical vapor growth method, and others may be adopted; however, the vapor growth carbon fiber is produced by the chemical vapor growth method. The term VGCF representing the vapor growth carbon fiber is an abbreviation of Vapor Growth Carbon Fiber.

As to the mode of containing the fibrous carbon material in the composite material, the fibrous carbon material can be homogeneously dispersed in the whole of the matrix. Also, the fibrous carbon material can be made into a sheet form and alternately superposed with a matrix layer to construct a laminate body. By constructing the laminate body, the fibrous carbon material will be intensively present within the substrate. As compared with a case of dispersion type in which the fibrous carbon material is homogeneously dispersed in the whole of the matrix, in the case of the same content, the property of the fibrous carbon material can be manifested more effectively. As a result thereof, the amount of use of the fibrous carbon material can be reduced.

The fibrous carbon material can also be oriented in the matrix. As the mode of orientation, there are two kinds, where one is a one-dimensional orientation in which the fibrous carbon material is oriented in one specific direction, and the other one is a two-dimensional orientation in which the fibrous carbon material is oriented in a direction parallel to a specific plane and is oriented in plural directions within the plane or is random. The non-orientation is a three-dimensional random mode in which the fibrous carbon material is oriented in three-dimensional random directions. A sheet constructed with the fibrous carbon material can be easily oriented in directions parallel to the surface thereof, and can be easily oriented in the same direction. By the orientation of the fibrous carbon material, the heat conductivity in the orientation direction can be improved to a further extent.

The spark plasma sintered body made from a metal powder as a source material can be subjected to plastic processing. By the plastic processing, for example, repeated stress by pressure-rolling, the fibrous carbon material at the powder boundary or the grain boundary will be oriented, and further, by dislocation integration, the self-organization proceeds. However, by the plastic processing, the heat conductivity may sometimes decrease.

EFFECTS OF THE INVENTION

By using pure aluminum or an aluminum alloy that is excellent in corrosion resistance or heat dissipation property as a matrix, the highly heat-conductive composite material of the present invention can take advantage of the corrosion property or the excellent durability in a high-temperature environment that are inherently owned by these materials themselves. By compounding and integrating a fibrous carbon material into this material, the excellent electric conduction, heat conductivity, and the strength owned by the fibrous carbon material itself can be combined, whereby an increase in the desired properties, a synergistic effect, or a novel function can be manifested. The heat conduction function can be manifested particularly effectively when the matrix made from a metal powder sintered body is a metal powder sintered body made from a mixed powder of a sintering source material powder and a metal powder auxiliary agent made of an alloy belonging to the same series as the source material powder metal and having a melting point lower than the sintering temperature of the source material powder, that is, a metal powder auxiliary agent made of an Al—Si alloy having an Si content within a range of 9 to 15 wt % with its alloy melting point adjusted to be lower than the sintering temperature of the sintering source material powder, as a source material. Also, by restraint of the amount of use of the fibrous carbon material, the economical property can also be enhanced.

BEST MODES FOR CARRYING OUT THE INVENTION

Hereafter, embodiments of the present invention will be described with reference to the drawings.

In the present embodiment, a carbon material-containing aluminum composite material of fiber lamination type is produced in which sheets made from a fibrous carbon material are arranged at a predetermined interval within a spark plasma sintered body of an aluminum powder.

By this method, first, a one-dimensionally oriented sheet of a fibrous carbon material that will be a fiber layer is fabricated. That is, a fiber sheet is fabricated in which a vapor growth carbon fiber is one-dimensionally oriented in one direction parallel to the sheet surface. This fiber sheet may be one that is naturally produced during the vapor growth process. The sheet production method will be described in more detail.

A vapor growth carbon fiber is produced by simultaneously vapor-growing numerous lines from a substrate surface with use of a catalyst. As a result of this, the vapor growth carbon fiber is produced in a mode in which numerous lines of fibers are densely gathered in a two-dimensional manner on the substrate. The numerous lines of fibers densely gathered in a two-dimensional manner are in many cases in a state of having fallen down in one direction by a gas flow during the production process, and a fiber sheet oriented in one direction can be obtained simply by separating the densely gathered fiber from the substrate. This can be used, as it is, as a fiber sheet, or can be used after being lightly pressed. If the fibers are not fallen down, a fiber sheet one-dimensionally oriented in one direction can be obtained by letting the fibers fall down in one direction with use of a roller or the like.

Besides this, it is also possible to make a fiber sheet by applying a magnetic field or an electric field to the dispersion liquid of the vapor growth carbon fiber. It is also possible to form a fiber sheet in which the vapor growth carbon fiber is one-dimensionally oriented in one direction parallel to the sheet surface by a physical method such as a method of putting a dispersion liquid into an ejection device such as an injection syringe and extruding the liquid in plural lines along one direction, a method of allowing the dispersion liquid to flow along a standing plate, or a method of immersing a plate into a dispersion liquid and slowly pulling up the plate.

Before or after forming the fibrous carbon material into a sheet, a spark plasma treatment can be performed on the fibrous carbon material, and it will be described later in detail that this treatment is effective for an elongation function of the fibrous carbon material, surface activation, diffusion of a powder substance, and the like.

When the one-dimensionally oriented sheet of the vapor growth carbon fiber is fabricated, a mixed powder of a pure aluminum powder and an Al-12Si alloy powder is allowed to adhere onto both surfaces or one surface of the sheet. The fiber sheets to which the mixed powder adheres are superposed for a predetermined number of sheets, pressurized, and subjected to spark plasma sintering to fabricate a fibrous carbon material-containing aluminum composite material of fiber lamination structure.

When the sheets in which the vapor growth carbon fiber is oriented in the same direction are laminated, it is important to align the orientation direction thereof. The spark plasma sintering processing, the subsequent plastic processing, the spark plasma treatment to the fibrous carbon material in advance, and the like will be described later.

The step of sintering (treating) by a spark plasma is a method in which the aforesaid laminate body is put between a die and punches, and a direct current pulse current is allowed to flow while pressing the laminate body with upper and lower punches, and Joule heat is thus generated in the die, the punches, and the treated material to sinter the sintering source material powder, and by allowing a pulse current to flow, a spark plasma is generated between the powder particles or between the vapor growth carbon fibers, and impurities on the surface of the powder and the vapor growth carbon fiber disappear to cause activation and the like, namely, by such actions, the sintering proceeds smoothly.

The condition of the spark plasma treatment that is performed on only the vapor growth carbon fiber is not particularly limited; however, it can be appropriately selected, for example, in such a manner that the temperature is within a range of 200 to 1400° C., the time is within a range of about 1 to 2 hours, and the pressure is within a range of 0 to 10 MPa. By performing the spark plasma treatment before the spark plasma sintering step, functions and effects such as an elongation function of the fibrous carbon material, surface activation, and diffusion of the powder substance are generated, whereby the heat conductivity and the electric conductivity that are given to the sintered body will be improved together with the smooth progress of the subsequent spark plasma sintering.

The spark plasma sintering of the laminate body is preferably carried out at a lower temperature than the usual sintering temperature of the pure aluminum powder serving as a sintering source material powder. In sintering, a particularly high pressure is not required, and it is preferable to set conditions so as to perform a relatively low-pressure and low-temperature treatment.

In the spark plasma sintering of the laminate body, the pure aluminum powder serving as a sintering source material powder within the mixed powder is sintered. The metal powder auxiliary agent compounded into the pure aluminum powder is melted during the sintering process and fills the gap between the aluminum powder particles and between the aluminum powder particle and the vapor growth carbon fiber. This process will be described in detail later with reference to the drawings.

In the spark plasma sintering of the laminate body, a two-step process is also preferable in which, first, plasma discharge is carried out at a low temperature under a low pressure, then, spark plasma sintering is conducted at a low temperature under a high pressure. It is also possible to utilize deposition and hardening after sintering, and phase transformation by various heat treatments. Levels of pressure and temperature are relative between the above-mentioned two steps, and it is advantageous that a difference in the level is set between the two steps.

The step of plastic deformation of the obtained spark plasma sintered body may be carried out by any rolling method of cold rolling, warm rolling, and hot rolling besides a known press-molding. For example, an optimum rolling method is selected in accordance with the metal species of the metal sintered body, the ceramics species to be mixed, and the amount of the fibrous carbon material. Also, in performing the rolling of a plurality of passes, it is possible to combine the cold rolling and the warm rolling, for example.

The cold rolling is such that the obtained block-shaped, plate-shaped, or linear sintered body is subjected to rolling as it is. By one pass or repeating a plurality of passes under a desired draft, the sintered body can be processed into a plate material, a thin plate, or a wire rod having a desired thickness. The draft for one pass, the total draft, the diameter of the mill roll, and the like are appropriately selected in accordance with the metal species, the ceramics species to be mixed, and the amount of the fibrous carbon material so that no cracks or the like may be generated in the rolled material.

The press-molding or the rolling by a warm process or a hot process can be appropriately selected in accordance with the desired mode and material quality. For example, they can be adopted when the cold rolling is not easy in accordance with the properties of the metal sintered body or for the purpose of improving the rolling efficiency. The temperature of heating the material is appropriately selected by considering the draft for one pass, the total draft as well as the number of passes, the diameter of the mill roll, and the like in accordance with the metal species of the metal sintered body, the ceramics species to be mixed, and the amount of the fibrous carbon material.

The press-molding and the annealing step after rolling are carried out as necessary and, for example, an optimal rolling method, a combination, and a rolling condition are selected in accordance with the metal species, the ceramics species to be mixed, and the amount of the fibrous carbon material as described above. Further, the time of annealing, the temperature condition, the number of processes, and the like are appropriately selected in accordance with the selected rolling method, combination, the rolling condition, and the like in order to improve the rolling effect further by reducing the residual stress of the rolled metal material, or for the purpose of easily obtaining the desired characteristics, or the like.

The composite material of the present invention that has been subjected to plastic deformation or to plastic deformation and annealing can be easily subjected to further mechanical processing, so that it can be processed into various shapes in accordance with the intended purpose or mode. Further, the processed metal materials may be subjected to a process of bonding with each other or with a different material with use of a wax material or by pressure-bonding with spark plasma.

The above is a production example of a one-dimensional orientation type composite material and, for the production thereof, a fiber lamination structure has been adopted. However, in producing a non-oriented type composite material, there is no need to adopt a fiber lamination structure, so that a composite material of fiber dispersion structure may be produced.

In producing a non-oriented type composite material of fiber dispersion structure, a pure aluminum powder serving as a sintering source material powder, an Al-12Si powder serving as a metal powder auxiliary agent, and a vapor growth carbon fiber serving as a fibrous carbon material are sufficiently mixed at a predetermined ratio with use of a blender. After the mixing, this mixture is subjected to spark plasma sintering. The sintering method, the subsequent plastic processing, and the like are the same as in the case of producing a non-oriented type composite material of fiber dispersion structure.

FIG. 1 is a schematic view illustrating a process of producing a carbon material-containing aluminum composite material containing a fibrous carbon material in a spark plasma sintered body made from a mixed powder of a pure aluminum powder and an Al-12Si powder as a source material. The sintering temperature and the melting point that are present in the drawings and described in the following are all detected temperatures by a thermocouple inserted into the sintering mold.

Whether the case of an oriented type composite material of fiber lamination structure or the case of a non-oriented type composite material of fiber dispersion structure, before sintering, the fibrous carbon material is contained within the matrix powder in which an Al-12Si powder is compounded into a pure aluminum powder (see the lower part in FIG. 1). The melting point of pure aluminum serving as a sintering source material powder is 600° C., and the sintering temperature thereof is 560° C. On the other hand, the melting point of Al-12Si serving as a metal powder auxiliary agent is 520° C. which is lower than the sintering temperature of pure aluminum, and the sintering temperature thereof is 470° C. which is further lower than that.

In the spark plasma sintering, spark plasma heating is started in a pressurized state. By the pressurization, the filling density of a pure aluminum powder, an Al-12Si powder, and a fibrous carbon material is raised. When the heating temperature reaches the softening point (250° C.) of Al-12Si in this state, the Al-12Si powder particles are softened and deformed so as to penetrate between the pure aluminum powder particles and between the pure aluminum powder particle and the fibrous carbon material, thereby starting to fill the gap (see the middle part in FIG. 1).

When the heating temperature reaches the melting point of Al-12Si, the gap is completely filled with Al-12Si. When the heating temperature reaches the sintering temperature of pure aluminum in this state, the pure aluminum powder particles are integrated with each other by solid phase diffusion joining. The gap between the integrated pure aluminum and the fibrous carbon material is completely filled with Al-12Si (see the upper part in FIG. 1). At the interface, an Si-diffused layer shown by hatched lines in the drawing is formed.

Thus, a fibrous carbon material-containing composite material containing an aluminum sintered body as a matrix is produced. In the produced composite material, the gap between pure aluminum and the fibrous carbon material is completely filled with Al-12Si, and the sinterability is improved (the porosity approaches to zero) to improve the heat conductivity.

When an Al-12Si powder is not used, pure aluminum constituting the matrix particles is not melted, and the adhesion property with the fibrous carbon material is not good. Even if it is melted, the wettability with the carbon constituting the fibrous carbon material is not good. On the other hand, in the case in which an Al-12Si powder is used, Al-12Si is melted. Also, by the influence of the Si element with in the melted Al-12Si, an Si-rich layer is formed on the carbon surface constituting the fibrous carbon material, and an Si-diffused layer is formed on the pure aluminum surface. As a result of this, the heat is transferred through the path of (carbon)-(Si-rich layer)-(Al-12Si)—(Si-diffused layer)-(Al). Here, since Al-12Si has a better wettability to Si than carbon, the heat conductivity between Al-12Si and carbon is improved by formation of the Si-rich layer. Also, the wettability between Al-12Si and pure aluminum is good irrespective of the presence or absence of the Si-diffused layer. Due to these reasons, the heat conductivity between pure aluminum and the fibrous carbon material will be extremely good.

On the other hand, however, Si has a fear of randomly reflecting heat. For this reason, a large amount of Si should be avoided, and from this viewpoint also, the Si content and the Al—Si powder amount in the Al—Si powder are restricted.

EXAMPLE 1

In a non-oriented type composite material of fiber dispersion structure, the effectiveness of containing the Al-12Si powder was examined. As a matrix mother material, a pure aluminum powder having an average particle size of 35 μm was used. To this, an Al-12Si powder having an average particle size of 40 μm was compounded, and the influence thereof given to the heat conductivity and the mechanical properties was examined. As a fibrous carbon material, a vapor growth carbon fiber having a thickness of 1 to 50 μm (10 μm on average) and a length of about 2 to 3 mm was used.

After the pure aluminum powder, the Al-12Si powder, and the vapor growth carbon fiber were sufficiently kneaded with use of a kneading machine, the kneaded material was put into a die of a spark plasma sintering apparatus, and spark plasma sintering was carried out under a condition of 560° C. and 60 minutes. During that time, the temperature rising rate was set to be 20° C./min, and a pressure of 30 MPa was continuously applied.

The heat characteristics and the porosity of the obtained non-oriented type composite material of fiber dispersion structure were examined. The heat characteristics evaluation test piece is a circular disk having a diameter of 10 mm and a thickness of 3 mm. As a measuring apparatus, TC-7000 manufactured by ULVAC-RIKO, Inc. was used. By this, the heat diffusion ratio and the specific heat were determined, and were converted into heat conductivity. The density and the porosity were measured by the Archimedes method.

The result of examination of the heat conductivity and the porosity is shown in FIG. 2. The compounding ratio of Al-12Si in the matrix was set to be 0, 10, and 20% by wt %. The content of the vapor growth carbon fiber in the composite material was set to be 0, 30, and 60% by vol %.

When the vapor growth carbon fiber is not contained, the heat conductivity decreases a little by compounding Al-12Si into the Al matrix. This seems to be because, when the vapor growth carbon fiber is not contained, there is no problem of a decrease in the sinterability and a decrease in the adhesion property, and the random reflection of heat by the Si-diffused layer became conspicuous. On the other hand, when the vapor growth carbon fiber is contained in the matrix, the heat conductivity will be improved by compounding Al-12Si into the Al matrix. This seems to be because, when the vapor growth carbon fiber is contained, there is a problem of a decrease in the sinterability and a decrease in the adhesion property, and this problem was eliminated by compounding of Al-12Si.

In the case in which Al-12Si is not compounded, the porosity shows a considerable increase when the vapor growth carbon fiber is contained at 60 vol %. It can be fully predicted that this gives adverse effects on the mechanical properties. When Al-12Si is compounded, the porosity does not increase and is almost zero even if the vapor growth carbon fiber is contained at 60 vol %.

From this experiment, it is clear that, when the fibrous carbon material is contained, the compounding of Al-12Si into the Al matrix is effective for improvement in the heat conductivity and an improvement in the mechanical properties.

FIG. 3 is a graph showing a relationship between the content of the vapor growth carbon fiber and the heat conductivity in both of a case in which Al-12Si is compounded at 10% and a case in which it is not compounded in the aforesaid non-oriented type composite material having a fiber dispersion structure.

When the content of the vapor growth carbon fiber is zero or a slight amount, the heat conductivity decreases by compounding of Al-12Si. However, after passing through the point at which the content of the vapor growth carbon fiber exceeds 10%, the heat conductivity rises by compounding of Al-12Si, and the rising rate will be more conspicuous according as the content of the vapor growth carbon fiber increases.

EXAMPLE 2

In a one-dimensional oriented type composite material of fiber lamination structure, the effectiveness of an Al-12Si powder was examined. As a mother material powder of the matrix, a pure aluminum powder having an average particle size of 35 μm was prepared, and an Al-12Si powder having an average particle size of 40 μm was prepared as an auxiliary agent powder. Then, as the matrix powder, two kinds were prepared, where one kind was a pure aluminum powder alone, and the other kind was a mixed powder in which an Al-12Si powder was compounded at 10 wt % into a pure aluminum powder.

As a fibrous carbon material, an orientation sheet of a vapor growth carbon fiber was prepared. The orientation sheet of the vapor growth carbon fiber is a densely gathered body of the vapor growth carbon fiber having a thickness of 1 to 50 μm (10 μm on average) and a length of about 2 to 3 mm, and is a fiber orientation sheet having a thickness in the order of 100 μm in which the direction of the fiber orientation is the same direction parallel to the surface. As described above, such an orientation sheet is produced naturally during the vapor growth process.

After numerous circular sheets having a diameter of 10 mm were stamped out from the fiber orientation sheet, the circular sheets were superposed on one another while mounting the matrix powder on those circular sheets, so as to fabricate a cylindrical laminate body having a diameter of 10 mm and a height of 20 mm.

At this time, by adjustment of the amount of the matrix powder that is sandwiched between the circular orientation sheets, the volume content of the vapor growth carbon fiber was variously changed within a range of 0 to 60%. That is, by increasing the amount of the matrix powder, the content of the vapor growth carbon fiber decreases, and the number of lamination of the fiber orientation sheets in the cylindrical laminate body also decreases. Conversely, by decreasing the amount of the matrix powder, the content of the vapor growth carbon fiber increases, and the number of lamination of the orientation sheets in the cylindrical laminate body also increases. As a result of this, the number of lamination of the circular orientation sheets in the cylindrical laminate body changed within a range of about 100 to 250 sheets. In stacking the circular orientation sheets, attention was paid so that the orientation direction of the vapor growth carbon fiber within them would be the same direction.

The fabricated various cylindrical laminate bodies were put into a die of a spark plasma sintering apparatus, and were pressurized in a height direction. By this procedure, cylindrical laminate bodies 10 in the die were compressed to have a height of about 15 mm. In this state, the cylindrical laminate bodies in the die were subjected to spark plasma sintering under conditions of 560° C. and 60 minutes. During this, the temperature rising rate was set to be 20° C./min, and a pressure of 30 MPa was continuously applied. As a result of this, a cylindrical fibrous carbon material-containing aluminum composite material was produced in which the carbon fiber layers perpendicular to the central line were laminated in numerous layers at a predetermined interval in the central line direction within the cylindrical aluminum powder sintered body.

Schematic views of the produced composite material are shown in FIGS. 5(*a*) and 5(*b*). In the produced cylindrical composite material 10, a disk-shaped matrix powder sintered layer 12 and a fibrous carbon material layer 11 are alternately laminated. The diameter of the composite material 10 was 10 mm, and the height thereof was about 11 to 12 mm due to the contraction during the pressurizing sintering step. The fibers in the fibrous carbon material layer 11 are such that vapor growth carbon fibers 1 are oriented in the same direction parallel to the layer surface (perpendicular to the central line of the composite material).

In order to measure the heat conductivity in the fiber orientation direction, disk-shaped test pieces 20 in a direction perpendicular to the central line of the composite material 10 were collected from the central part in the fiber orientation direction of the cylindrical composite material 10. The test pieces 20 have a diameter of 10 mm and a thickness of 2 to 3 mm, and the central line of the test pieces 20 is perpendicular to the central line of the composite material 10 and coincides with the orientation direction of the vapor growth carbon fiber 1 in the fibrous carbon material layer 11. That is, in each test piece 20, the fibrous carbon material layers 11 perpendicular to the central line thereof are laminated at a predetermined interval in a direction perpendicular to the carbon material layers 11, and the orientation direction of the vapor growth carbon fiber 1 in each carbon material layer 11 coincides with the central line direction of the test piece 20.

For each of the produced composite materials, the heat conductivity in the central line direction, namely in the vapor growth carbon fiber orientation direction, was measured with use of a collected test piece. The result of measurement of the heat conductivity is shown in FIG. 4.

When the content of the vapor growth carbon fiber is zero or a slight amount, the heat conductivity decreases by compounding of Al-12Si. However, after passing through the point at which the content of the vapor growth carbon fiber exceeds 10%, a tendency can be seen such that the heat conductivity rises by compounding of Al-12Si, and the rising rate will be more conspicuous according as the content of the vapor growth carbon fiber increases. This tendency is more conspicuous than in the case of Example 1 (non-oriented type composite material of fiber dispersion structure).

To describe more specifically, the heat conductivity of a spark plasma sintered body of a pure aluminum powder alone is about 200 W/mK. When the vapor growth carbon fiber is contained at about 40 vol %, the heat conductivity rises to two-fold. Also, when the vapor growth carbon fiber is contained at 60 vol %, the heat conductivity will rise to 500 W/mK which is 2.5-fold. On the other hand, in the case in which an Al-12Si powder is contained in a pure aluminum powder, the heat conductivity reaches two-fold when the content of the vapor growth carbon fiber is 30 vol % or less, and the heat conductivity reaches 500 W/mK which is 2.5-fold when the content is 30 to 40 vol %. In the case of ensuring the same heat conductivity, the amount of use of the vapor growth carbon fiber will be reduced to ¾ to ½ by compounding an Al-12Si powder into a pure aluminum powder.

In this manner, in producing a fibrous carbon material-containing aluminum composite material, when the material is produced by adding a small amount of an Al-12Si powder into a mother material metal powder of the matrix, the heat conductivity can be improved without increasing the amount of the fibrous carbon material, so that the amount of use of the fibrous carbon material can be reduced in the case of ensuring the same heat conductivity.

DESCRIPTION OF THE REFERENCE NUMERALS

Figure 1:
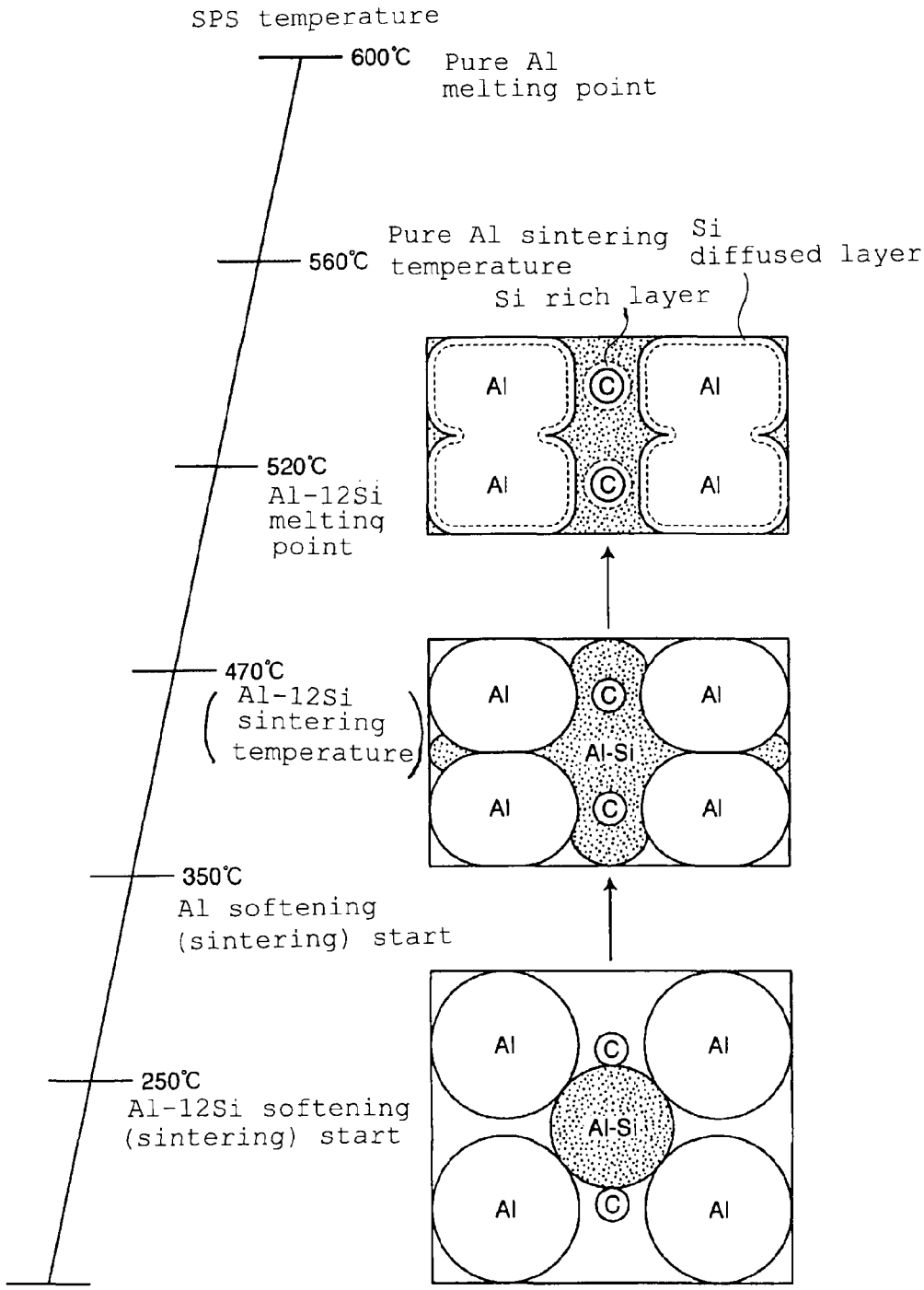
FIG. 1 is a schematic view illustrating a process of producing a carbon material-containing aluminum composite material containing a fibrous carbon material in a spark plasma sintered body made from a mixed powder of a pure aluminum powder and an Al-12Si powder as a source material.
Figure 2:
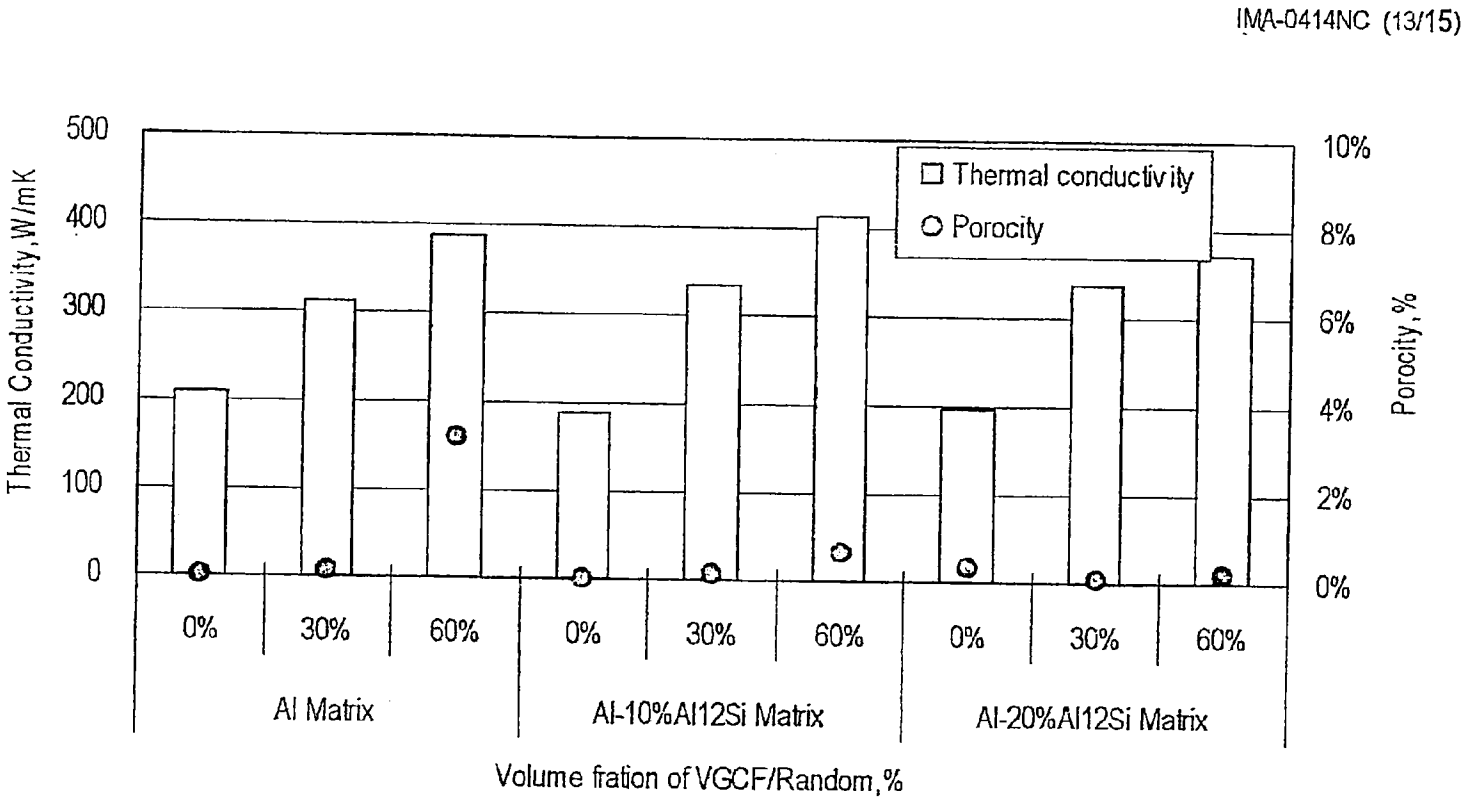
FIG. 2 is a graph showing effectiveness of an Al-12Si powder compounding in a non-oriented type composite material having a fiber dispersion structure, using the content of the fibrous carbon material as a parameter.
Figure 3:
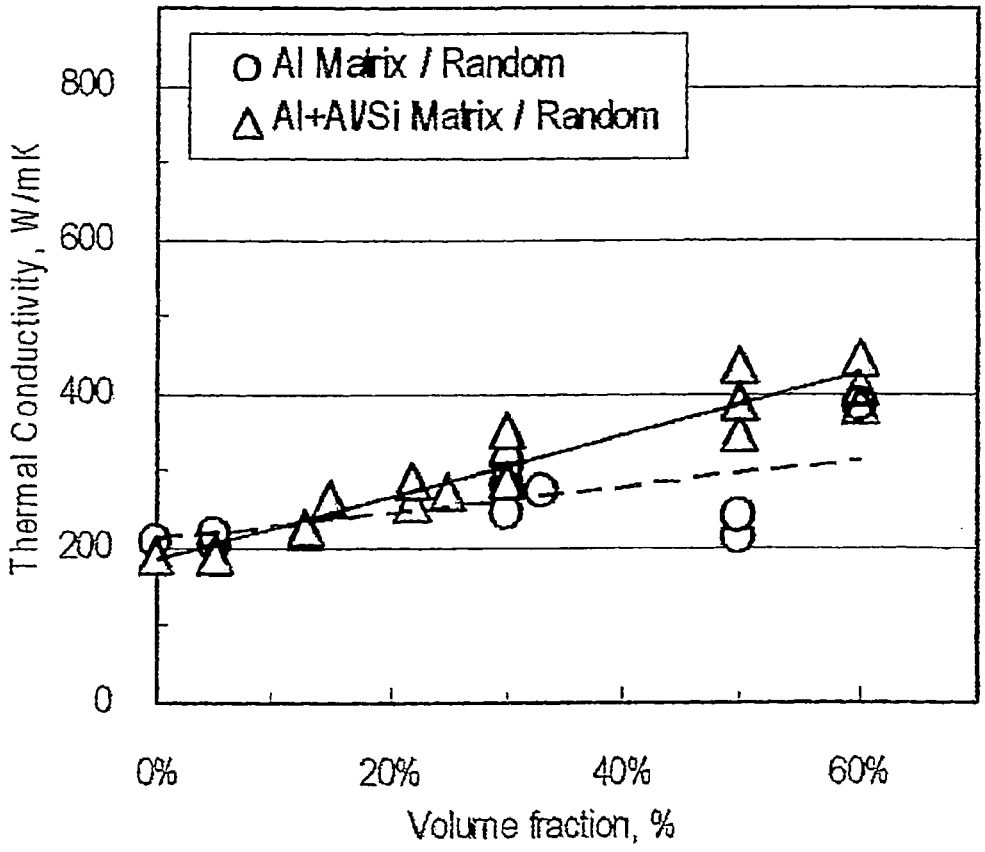
FIG. 3 is a graph showing a relationship between the content of the vapor growth carbon fiber and the heat conductivity in both of a case in which Al-12Si is compounded and a case in which it is not compounded in a non-oriented type composite material having a fiber dispersion structure.
Figure 4:
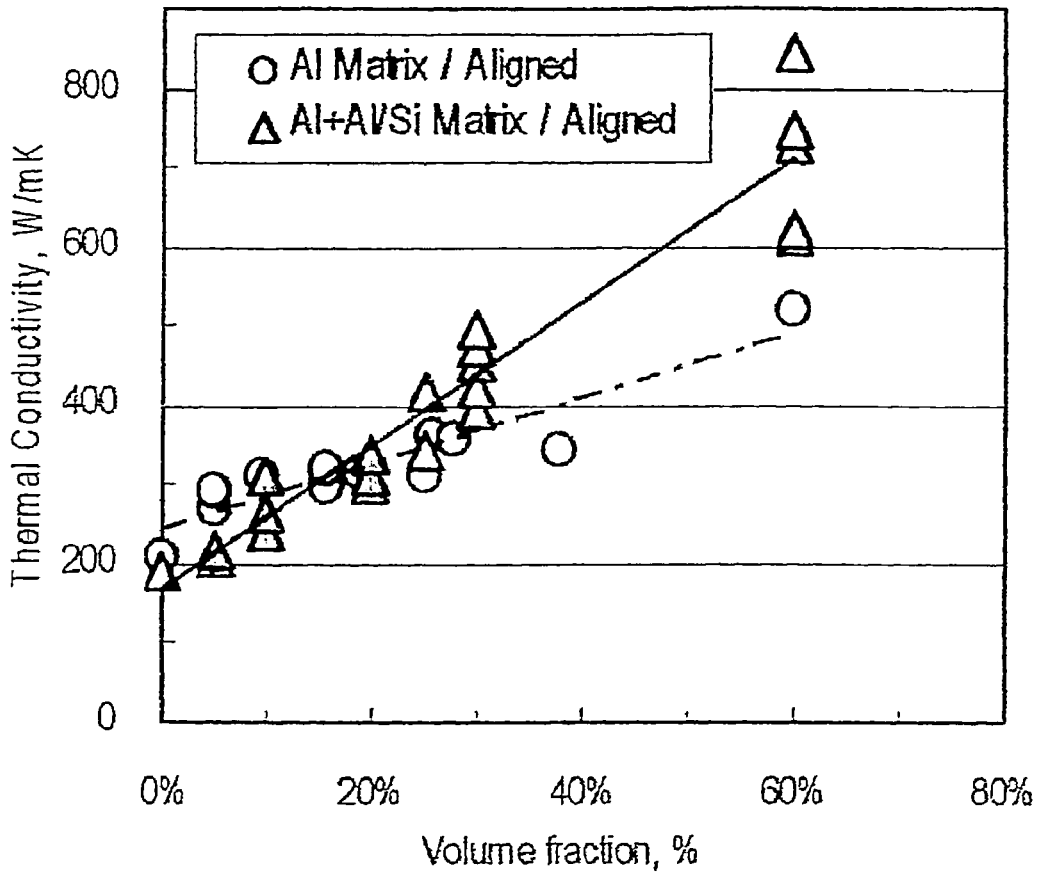
FIG. 4 is a graph showing a relationship between the content of the vapor growth carbon fiber and the heat conductivity in both of a case in which Al-12Si is compounded and a case in which it is not compounded in a one-dimensional oriented type composite material having a fiber lamination structure.
Figure 5:
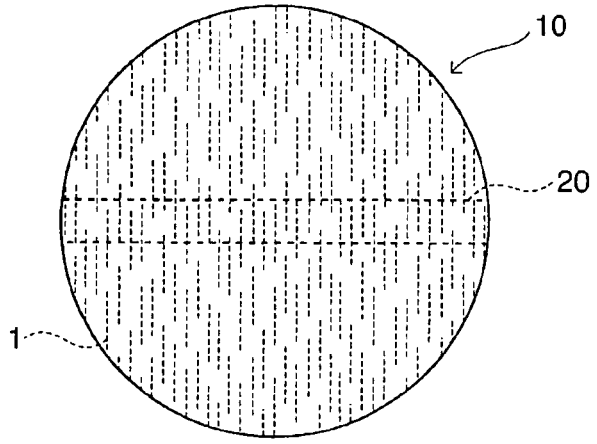
FIG. 5 is a schematic view showing each shape of the composite material fabricated in the examples and a test piece collected from the composite material, where FIG. 5(*a*) is a plan view and FIG. 5(*b*) is a front view.
Figure 5:
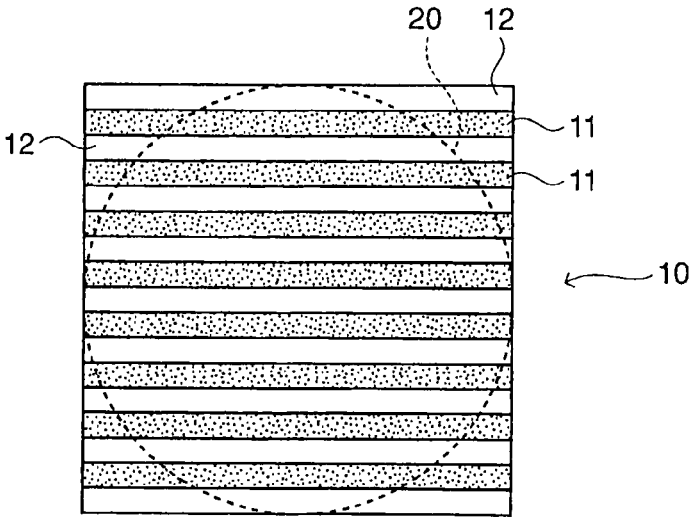

1 vapor growth carbon fiber (fibrous carbon material)
10 composite material
11 fibrous carbon material layer
12 matrix powder sintered layer
20 test piece

The invention claimed is:

1. A heat-conductive composite material made from a mixture of a metal matrix and a fibrous carbon material, wherein said metal matrix is a metal powder sintered body made from a mixed powder of a sintering source material powder made of pure Al or an Al alloy and a metal powder auxiliary agent made of an Al—Si alloy as a source material, and the compounding ratio of the Al—Si alloy in said metal matrix is 5 to 20% by weight ratio, the Si amount in the Al—Si alloy is within a range of 9 to 15 wt %, and the melting point of the Al—Si alloy is adjusted to be lower than the sintering temperature of the sintering source material powder.

2. The heat-conductive composite material according to claim 1, wherein the Al—Si alloy is an alloy such that the amounts of alloy elements are adjusted so that its melting point will be lower than the sintering temperature of the sintering source material powder by 30° C. or more.

* * * * *